US010632358B2

(12) United States Patent
Gonzales

(10) Patent No.: US 10,632,358 B2
(45) Date of Patent: Apr. 28, 2020

(54) GAME PLAYABLE ON LAND OR WATER

(71) Applicant: Nicholas T. Gonzales, Chicago, IL (US)

(72) Inventor: Nicholas T. Gonzales, Chicago, IL (US)

(73) Assignee: KANKAKEE SPIKEBALL, INC., Chicago, IL (US)

( * ) Notice: Subject to any disclaimer, the term of this patent is extended or adjusted under 35 U.S.C. 154(b) by 0 days.

(21) Appl. No.: 15/911,102

(22) Filed: Mar. 3, 2018

(65) Prior Publication Data

US 2019/0269993 A1 Sep. 5, 2019

(51) Int. Cl.

| | |
|---|---|
| ***A63B 61/00*** | (2006.01) |
| ***A63B 71/02*** | (2006.01) |
| ***A63B 67/00*** | (2006.01) |
| ***A63B 67/06*** | (2006.01) |
| ***A63B 63/00*** | (2006.01) |
| *A63B 5/11* | (2006.01) |

(52) U.S. Cl.

CPC ..... *A63B 71/023* (2013.01); *A63B 61/00* (2013.01); *A63B 63/007* (2013.01); *A63B 67/007* (2013.01); *A63B 67/06* (2013.01); *A63B 5/11* (2013.01); *A63B 2071/026* (2013.01); *A63B 2209/08* (2013.01); *A63B 2209/10* (2013.01); *A63B 2210/50* (2013.01); *A63B 2225/09* (2013.01); *A63B 2225/60* (2013.01); *A63B 2225/605* (2013.01); *A63B 2225/682* (2013.01)

(58) Field of Classification Search

CPC ..... A63B 71/023

USPC ..... 273/342

See application file for complete search history.

(56) References Cited

U.S. PATENT DOCUMENTS

| | | | | | |
|---|---|---|---|---|---|
| 3,047,294 | A * | 7/1962 | Maxwell | A63B 5/11 | 182/139 |
| 3,430,958 | A * | 3/1969 | Lakeman | A63B 63/08 | 273/400 |
| 3,858,877 | A * | 1/1975 | Lundstrom | A63B 67/04 | 473/14 |
| 3,939,510 | A * | 2/1976 | Curd, Jr. | B63B 22/20 | 441/28 |
| 4,384,857 | A * | 5/1983 | Hoy, Jr. | A47C 15/006 | 114/331 |
| 4,401,047 | A * | 8/1983 | Auras | B63B 1/14 | 114/136 |
| 5,201,526 | A * | 4/1993 | Ketcham, Jr. | A63B 67/00 | 124/5 |
| 5,299,588 | A * | 4/1994 | MacLeod | A45B 11/00 | 135/16 |
| 5,499,822 | A * | 3/1996 | Sabourin | A63B 67/007 | 273/348 |

(Continued)

*Primary Examiner* — John E Simms, Jr.
*Assistant Examiner* — Dolores R Collins
(74) *Attorney, Agent, or Firm* — Justin Lampel

(57) ABSTRACT

A game playable on land or water is provided. The game may have a frame having a generally circular playing surface having a net and a plurality of legs attached to the frame. A plurality of buoys may be removably attached to the plurality of legs so that the game may float on water or the plurality of buoys may be removed from the legs so that the game may be played on land. A plurality of straps may connect the plurality of buoys to a centralized weighted anchor for balancing and stabilizing the game on water.

17 Claims, 8 Drawing Sheets

(56) References Cited

U.S. PATENT DOCUMENTS

| | | | | |
|---|---|---|---|---|
| 6,053,845 | A * | 4/2000 | Publicover | A63B 5/11 482/27 |
| 6,261,207 | B1 * | 7/2001 | Publicover | A63B 5/11 482/27 |
| 6,676,546 | B2 * | 1/2004 | Gordon | A63B 5/11 473/415 |
| 6,766,623 | B1 * | 7/2004 | Kalnay | E04B 1/34305 135/128 |
| 7,611,427 | B1 * | 11/2009 | Cline | A63B 5/11 473/459 |
| 8,002,282 | B1 * | 8/2011 | Koski | A63B 63/083 273/317 |
| 8,807,568 | B1 * | 8/2014 | Ruder | A63B 67/002 273/342 |
| 10,076,697 | B1 * | 9/2018 | Publicover | A63B 71/0054 |
| 2002/0010053 | A1 * | 1/2002 | Peterson | A63B 5/11 482/27 |
| 2002/0137598 | A1 * | 9/2002 | Publicover | A63B 5/11 482/27 |
| 2005/0043122 | A1 * | 2/2005 | Publicover | A63B 5/11 473/465 |
| 2005/0079955 | A1 * | 4/2005 | Yang | A63B 5/11 482/27 |
| 2006/0135321 | A1 * | 6/2006 | Chen | A63B 5/11 482/27 |
| 2008/0112759 | A1 * | 5/2008 | Hardison | B63B 21/29 405/25 |
| 2012/0252605 | A1 * | 10/2012 | Monroy | A63B 61/00 473/469 |
| 2013/0190137 | A1 * | 7/2013 | Kim | A63B 5/11 482/29 |

* cited by examiner

GAME PLAYABLE ON LAND OR WATER

BACKGROUND OF THE INVENTION

A game playable on land or water is provided. The game may have a frame having a generally circular playing surface having a net and a plurality of legs attached to the frame. A plurality of buoys may be removably attached to the plurality of legs so that the game may float on water or the plurality of buoys may be removed from the legs so that the game may be played on land. A plurality of straps may connect the plurality of buoys to a centralized weighted anchor for balancing and stabilizing the game on water.

Patents related to ball games have been granted in the past. For example, U.S. Pat. No. 8,807,568 to Ruder discloses a game having a generally flat surface which allows balls to bounce. The generally flat surface largely resembles a trampoline. In use, the generally flat surface is substantially parallel with respect to the ground. A user stands on solid ground outside a perimeter of the generally flat surface and bounces the ball off the generally flat surface. The height and tension of the generally flat surface may be easily adjusted.

Further, U.S. Pat. No. 8,002,282 to Koski discloses a ball game with skipping implement and targets comprised of a skipping implement having a highly efficient rebounding and skipping surface where by a player can throw a ball onto the skipping implement redirecting the ball in a multitude of directions including targeting a basket for recreation and game play.

Further, U.S. Pat. No. 5,201,526 to Ketcham, Jr. discloses an outdoor lawn-type game for two or more players in which discs are flipped from the ground onto a trampoline device comprised of a resiliently-tensioned net held in a horizontal position by a frame with legs. The discs are flipped using elongated flipping sticks with two bent fork tines at one end. The objective of the game, in getting a specified number of a players' or teams' discs to rest on the net, is rendered difficult by the resilient nature of the net and various options allowed by the rules of the game to dislodge an opponent's disc from the net or send an opponents disc to a point distant from the net. Various competitive strategies and skills are required by the individuals and/or the teams playing the game. No special ground surface is required. The game may be played on grass, in the woods or on the beach.

However, these devices fail to disclose a game playable on land or water which is easy to use, quick and inexpensive. Further, these devices fail to provide a game playable on land or water which allows a user to select between different setups quickly and easily.

SUMMARY OF THE INVENTION

A game playable on land or water is provided. The game may have a frame having a generally circular playing surface having a net and a plurality of legs attached to the frame. A plurality of buoys may be removably attached to the plurality of legs so that the game may float on water or the plurality of buoys may be removed from the legs so that the game may be played on land. A plurality of straps may connect the plurality of buoys to a centralized weighted anchor for balancing and stabilizing the game on water.

An advantage of the present game is that the present game is lightweight and portable.

And another advantage of the present game is that the present game has an anchor for stabilizing the location of the game in water.

Yet another advantage of the present game is that the present game can quickly switch from a land game to a water game.

In an embodiment, the game has a single ring buoy as opposed to a plurality of independent buoys.

Another advantage of the present game is that, in an embodiment, the game may have a cup holder for holding a beverage.

For a more complete understanding of the above listed features and advantages of the present game playable on land or water reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A game playable on land or water is provided. The game may have a frame having a generally circular playing surface having a net and a plurality of legs attached to the frame. A plurality of buoys may be removably attached to the plurality of legs so that the game may float on water or the plurality of buoys may be removed from the legs so that the game may be played on land. A plurality of straps may connect the plurality of buoys to a centralized weighted anchor for balancing and stabilizing the game on water.

Figure 1:
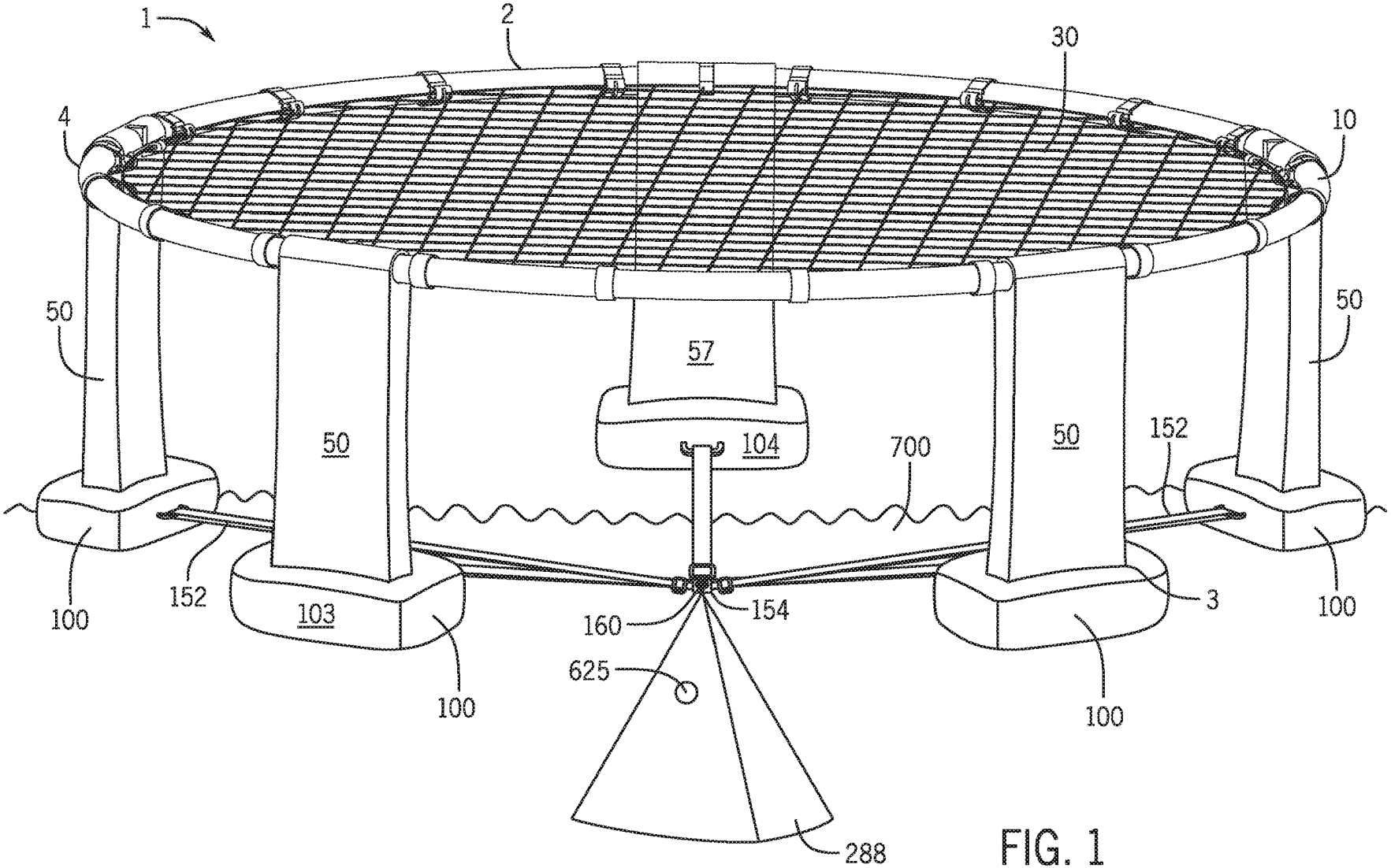
FIG. 1 illustrates a perspective view of the game playable on land or water wherein the removable buoys are attached to the legs.

Referring now to the drawings, FIG. 1 illustrates a game 1 for playing on land or water 700. The game 1 may have a frame 10, a flexible bouncing (elastic) surface 30, a plurality of legs 50, and, in an embodiment, removable buoys 100 attached to an anchor 288. The bouncing surface 30 is preferably a netting secured to the frame 10 and acts similar to a trampoline for bouncing a ball (not shown) off of. In an embodiment, the legs 50 and/or frame 10 are hollow so as to reduce the overall weight of the game 1 for transportation and to further to increase the buoyance of the game 1 so as to allow the game 1 to float in water 700. Further, the interior of the frame 10 and/or the plurality of legs 50 may have a water-tight seal so as to prevent taking on water so as to increase the overall buoyancy of the game 1.

The game 1 may have a top 2, a bottom 3 and a side 4. Preferably, the game 1 is generally circular, although the game 1 may be of any suitable size and shape. The frame 10 and the legs 50 of the game 1 are preferably durable and preferably light-weight so that the game 1 is capable of floating or so that at least the game 1 may be supported by the floatable buoys 100 as described below.

Figure 2:
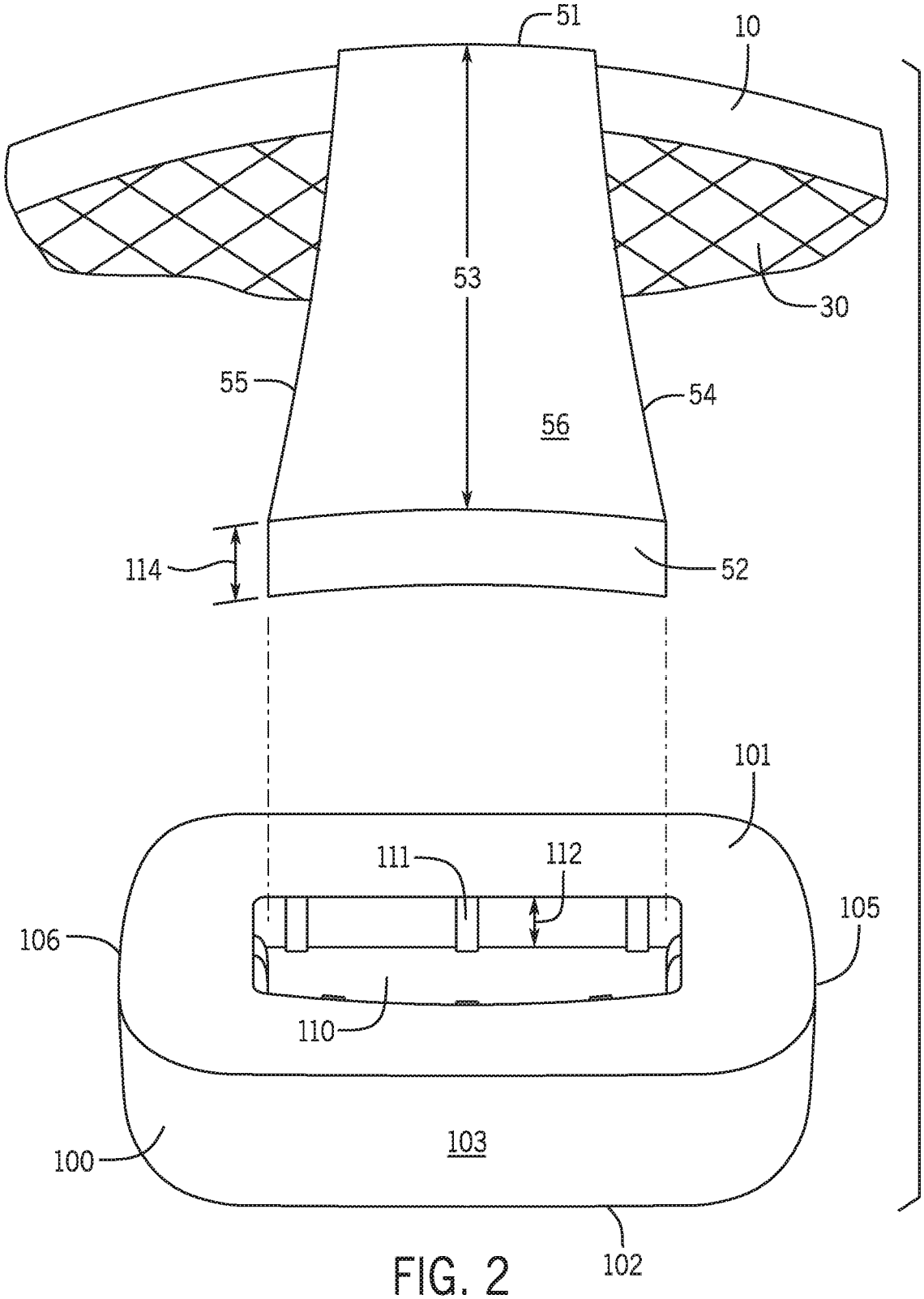
FIG. 2 illustrates a perspective view of the bottom of one of the legs being inserted into one of the buoys.

Referring now to FIG. 2, in an embodiment the legs 50 of the game 1 may have a first end 51, a second end 52 and a length 53 defined by the distance between the first end 51 and the second end 52. The legs 50 may further have a first side 54, a second side 55, a front 56 and a back 57 (FIG. 1). Preferably, all the plurality of legs 50 are identical (or at least substantially similar). In an embodiment, the front 56 of the legs 50 may face outward, toward the players (not shown) while the back 57 of the legs 50 may face inward toward the center of the game 1. In an embodiment, the second end 52 of the legs 50 may be generally rectangular, but slightly curved as illustrated in FIG. 2.

Figure 3:
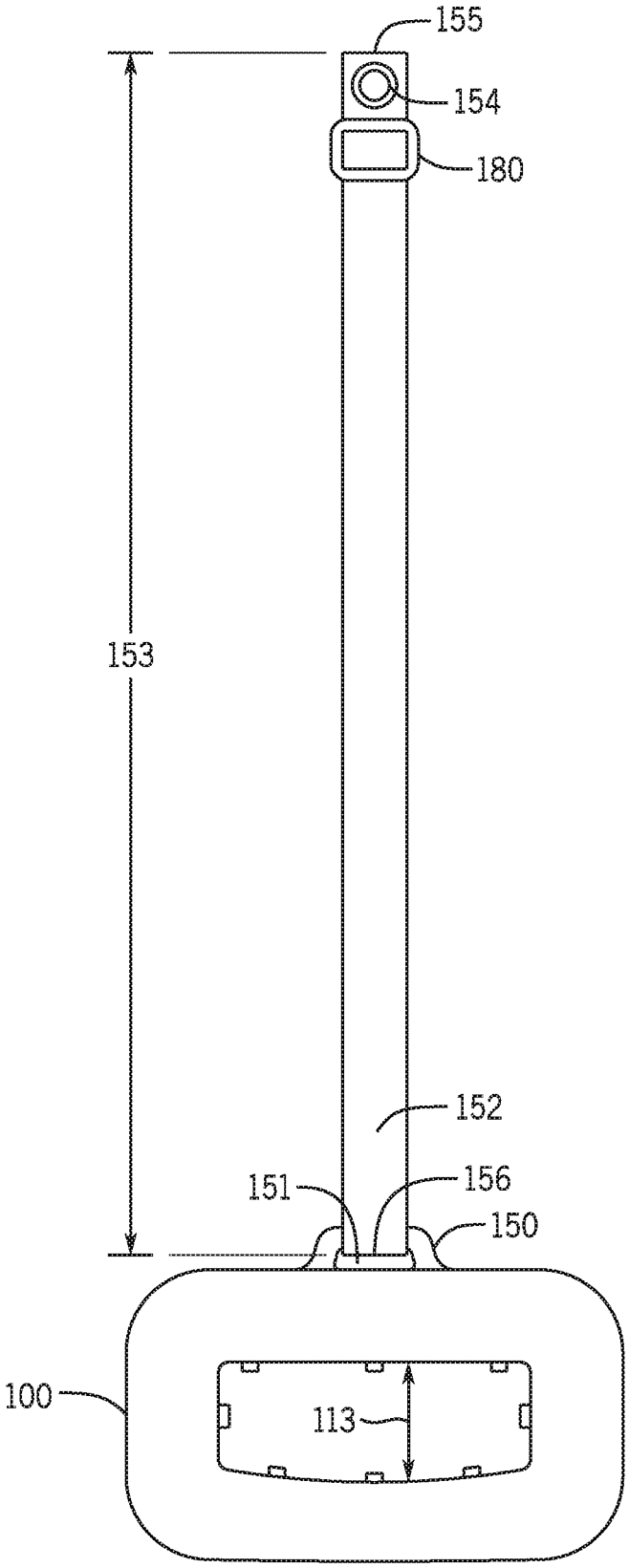
FIG. 3 illustrates a securing strap of the device connected to one of the plurality of buoys.

The plurality of buoys 100 may have a top 101, a bottom 102, a front 103, a back 104 (FIG. 1), a first side 105, a second side 106 and a generally concave interior portion 110. In an embodiment, the concave interior portion 110 may have a plurality of guide rails 111 and may further have a height 112 and a width 113 (FIG. 3). The width 113 of the concave interior portion 110 may be substantially similar to a width 114 of the legs 50. Further, the shape of the concave interior portion 110 may be substantially similar to the shape of the second end 52 of the legs 50 so that the second end 52 of the leg 50 may snugly fit into the concave interior portion 110 and be temporarily secured there by friction which may further be aided by the pressure of the rails 111.

The buoys 100 may have a completely sealed hollow interior so that the buoys 100 may float on water 700. In particular, the plurality of buoys 100 may all rest on the surface of the water 700 so that the buoys 100 and the plurality of legs 50 elevate the frame 10 and bouncing surface 30 of the game 1 above the water 700 for play. A ball (not shown) may then be used to bounce off the bouncing surface 30 in a game of roundent so that the game may be played in water 700.

In an embodiment, a loop extension 150 may be present on the back 104 of each of the plurality of legs 50. The loop extension 150 may have an opening 151 wherein the opening 151 receives a portion of a bendable strap 152. The bendable strap 152 may have a length 153 having a first end 155 and a second end 156. The length 153 of the bendable strap 152 may be generally equal to the radius of the bouncing surface 30. A securing ring 154 may be located near the first end 155 of the bendable strap 152. Each buoy 100 has its own bendable strap 152 and as a result, there is a plurality of securing rings 154. Although the number of buoys 100 used in the game 1 may vary depending on the set used, the illustrations show the preferable use of five buoys 100 supporting five legs 50. Thus, the five securing rings 154 of the five bendable straps 152 may be secured around a single bolt 160 (FIG. 1) located at the top of the anchor 288. A nut (not shown) may temporarily secure all of the securing rings 154 to the bolt 160 when all five bendable straps 152 are in place. The anchor 288 may prevent excessive movement of the game 1 in water 700.

Figure 4:
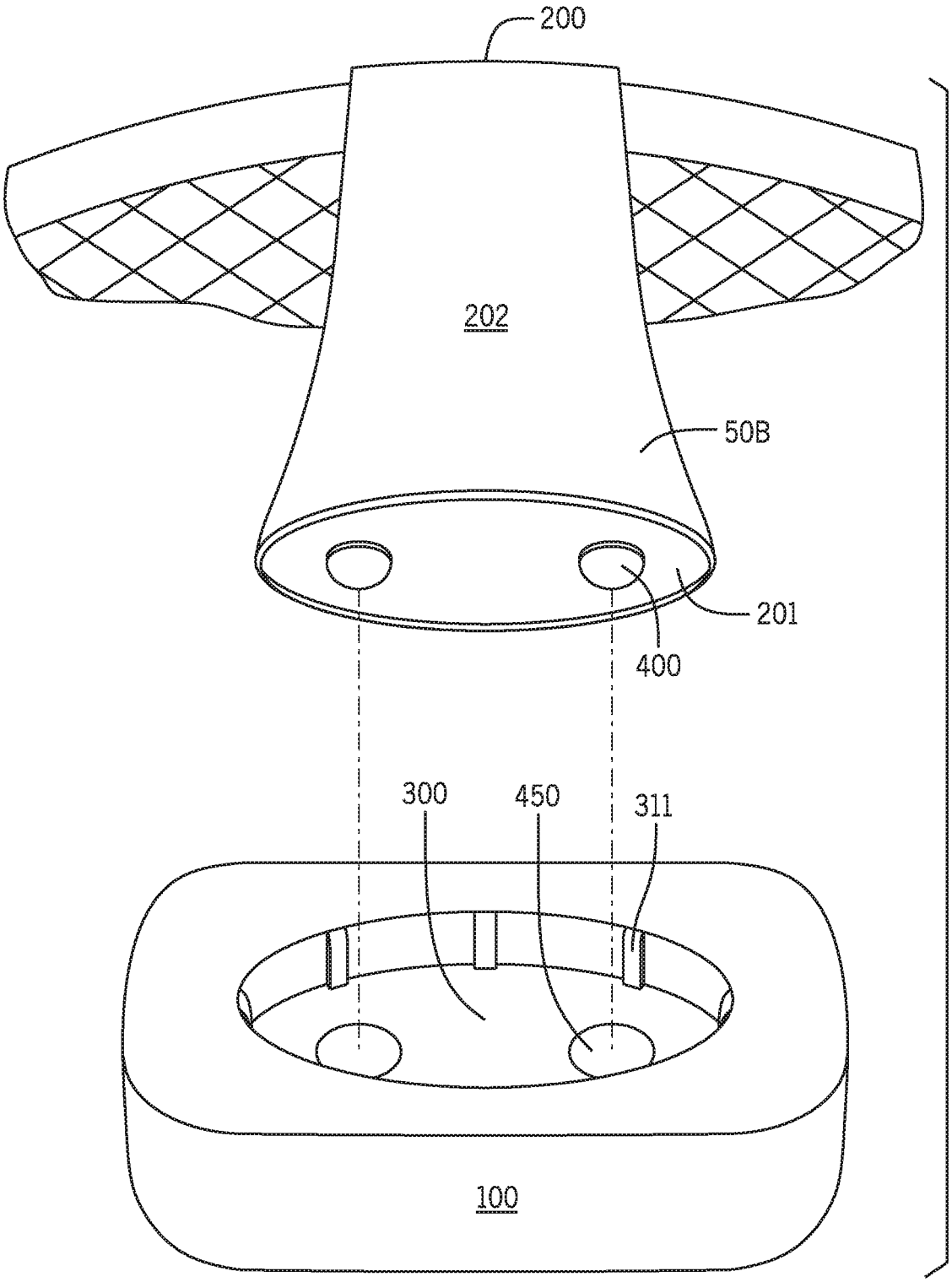
FIG. 4 illustrates a perspective view of the bottom of one of the legs, in an alternative embodiment, being inserted into one of the buoys.
Figure 5:
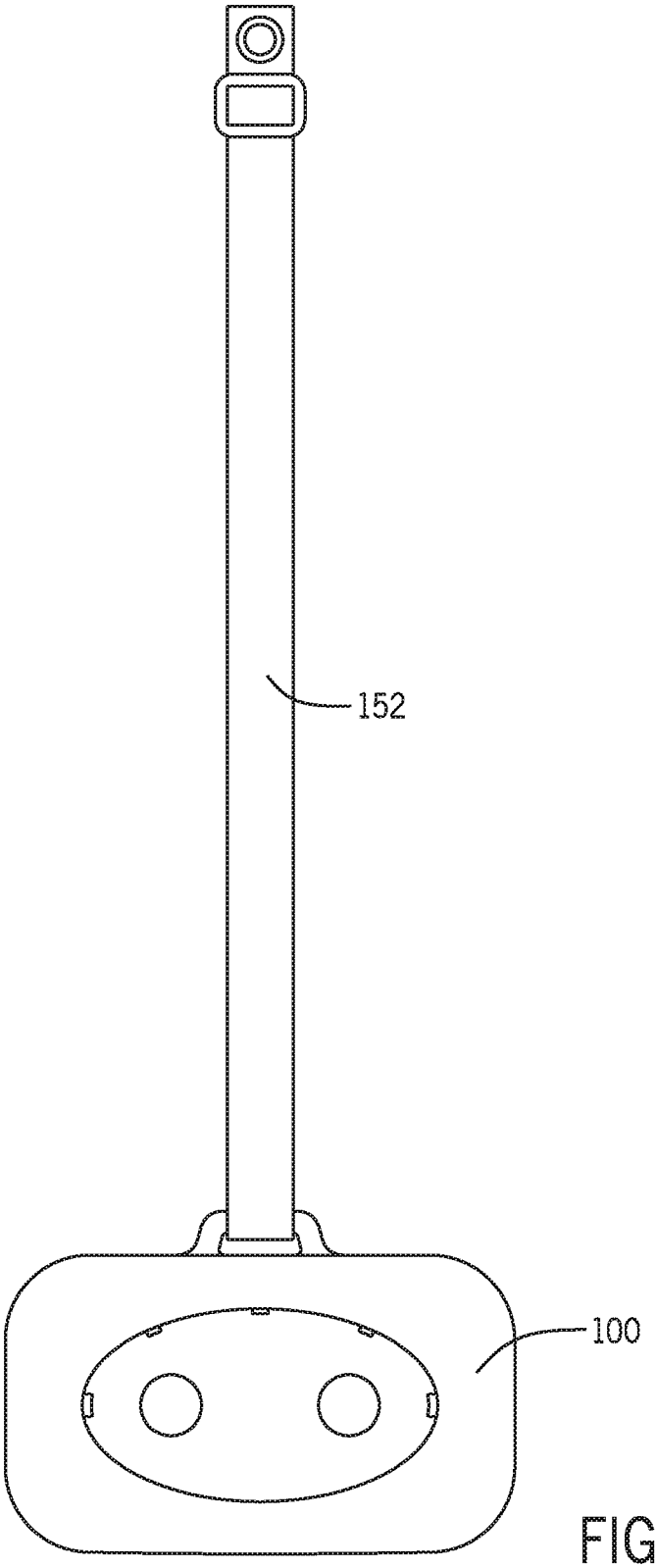
FIG. 5 illustrates a securing strap of the device connected to one of the plurality of buoys in an embodiment.

Referring now to FIG. 4, an alternative embodiment of the legs 50 of the game 1 is illustrated. In this embodiment, the legs 50B have a top 200, a bottom 201, a front 202, and a back (not shown). In the embodiment of FIG. 4, the bottom 201 of the legs 50 may be generally oval. In the oval embodiment, the bottom 201 of the legs 50 may correspondingly fit into an oval opening 300 in the buoy 100 in a similar manner as the opening of FIG. 2. In this embodiment, a plurality of rails 311 may also allow the legs 50 to snugly fit into the oval opening 300 and to remain in the opening 300 by friction.

In either of the leg 50 embodiments of FIG. 2 or 4, the bottom 201 of each of the legs 50 may further have at least one extended bump protrusion 400 which correspondingly is secured into a concave portion 450 of the oval opening 300 (or concave portion 110). It should be noted that the extended bump protrusion 400 embodiment may be used on either type leg (FIG. 2 or FIG. 4) despite being shown in the drawings only in the oval configuration of FIG. 4. The mating of the extended bump protrusion 400 to the concave portion 450 may provide additional surface area to secure and align the legs 50 to the buoy 100. In an embodiment, the extended bump protrusion 400 is magnetic and attracted to a corresponding magnet in the concave portion 450. Further, in an embodiment, the extended bump protrusion 400 also helps secure the game 1 to, for example, grass when the game 1 is played on land so that the game 1 does not shift.

In an embodiment, the buoy 100 may have both type openings 110, 300. In particular, the buoy 100 may have a top surface 101 as shown in FIG. 2 while the bottom surface 102 of the buoy 100 may have the oval opening 300 of FIG. 4 so that the same buoy 100 may be flipped upside-down and used with either type of leg 50 of the device 1. As a result, the buoys 100, the straps 152 and the anchor 288 may be used with different type legs 50 of, for example, a Spikeball® brand roundnet game (FIG. 1).

Referring again to FIG. 1, in an embodiment, the bendable strap 152 may connect all the buoys 100 to the anchor 288. The anchor 288 may be a weighted object which sinks in water 700 and weighs down the game 1 so that the game 1 does not move or at least is resistant to moving in water 700. In an embodiment, the anchor 288 may have a resealable opening 625 for receiving, for example, sand or other items which may weigh the anchor 288 down in the water 700. In an embodiment, the anchor 288 may be, for example, a foldable and/or bendable bag or sack which may be filled with, for example, sand. In the bendable bag embodiment, the anchor 288 may be collapsed after use (and after emptying the contents) for easier transportation. In an embodiment, the anchor 288 is secured (via the bendable straps 152) toward the center of the game 1 (in a spokewheel manner) so that the game 1 is properly weighted. Thus, the bendable straps 152 must be of identical (or nearly identical) length 153. A clasp 180 on the bendable strap 152 may allow for minor adjustment of the overall length 153 of the bendable strap 152 so as to allow for the balancing of the game 1 in the water 700.

Figure 6:
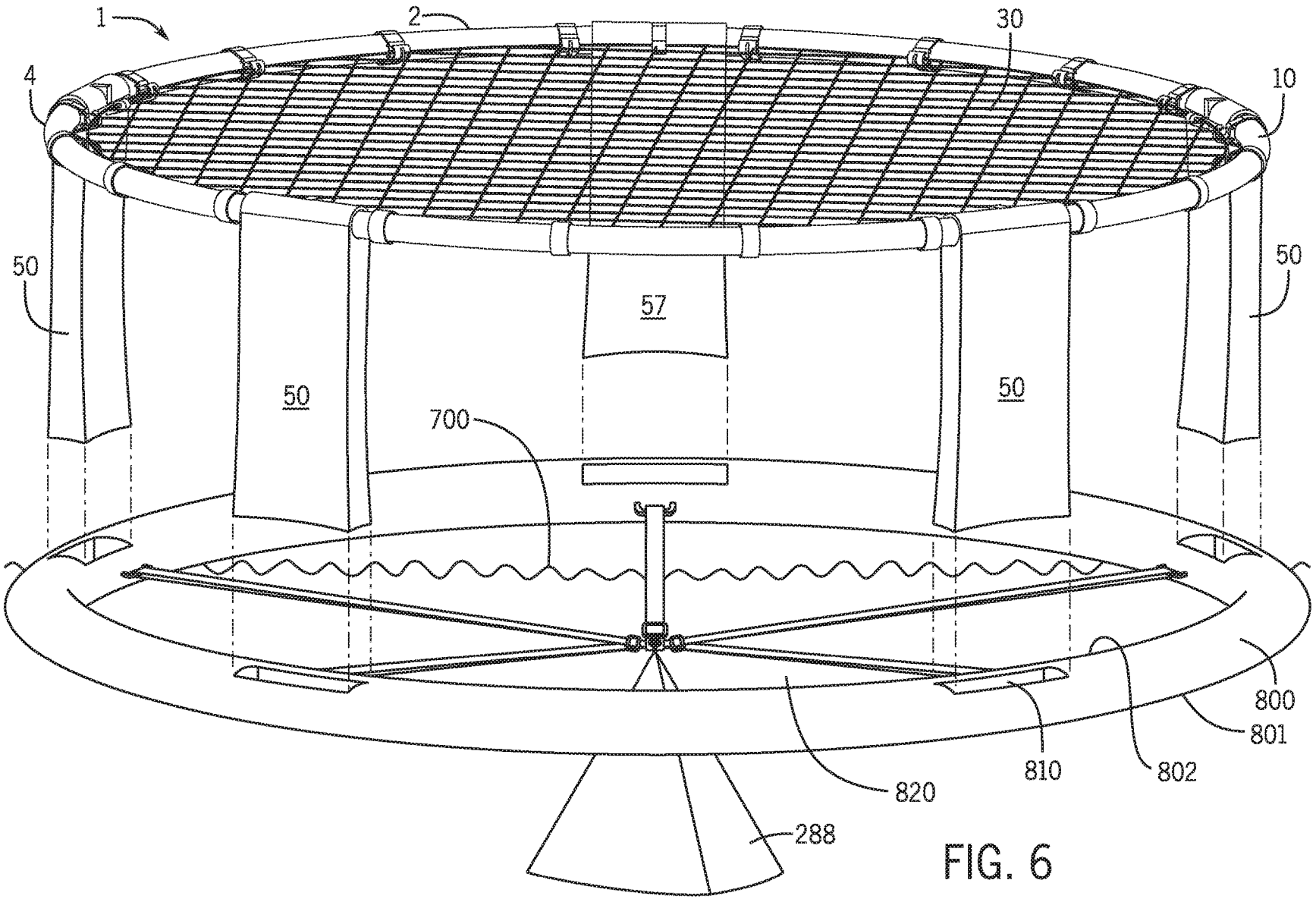
FIG. 6 illustrates an alternative embodiment wherein a single ring buoy is utilized as opposed to a plurality of individual buoys.

Referring now to FIG. 6, in an alternative embodiment, the game 1 may utilize a single buoyant ring 800 as opposed to utilizing the plurality of individual buoys 100 shown in FIG. 1. In the single buoyant ring 800 embodiment of FIG. 6, the ring 800 may have an exterior facing side 801, an interior facing side 802 and a top side. The top side (and in an alternative embodiment the bottom side as well) may have a plurality of openings 810 located around the ring 800. The location of the openings 810 may correspond to the location of the plurality of legs 50 so that the plurality of legs 50 fit and are temporarily secured into the openings 810 in a similar manner as the individual buoys 100 described earlier. In an embodiment, the single buoyant ring 800 may further utilize the anchor 288 system described above so as to keep the game 1 level and to prevent excessive movement of the game 1 in the water 700 while playing the game 1.

Figure 7:
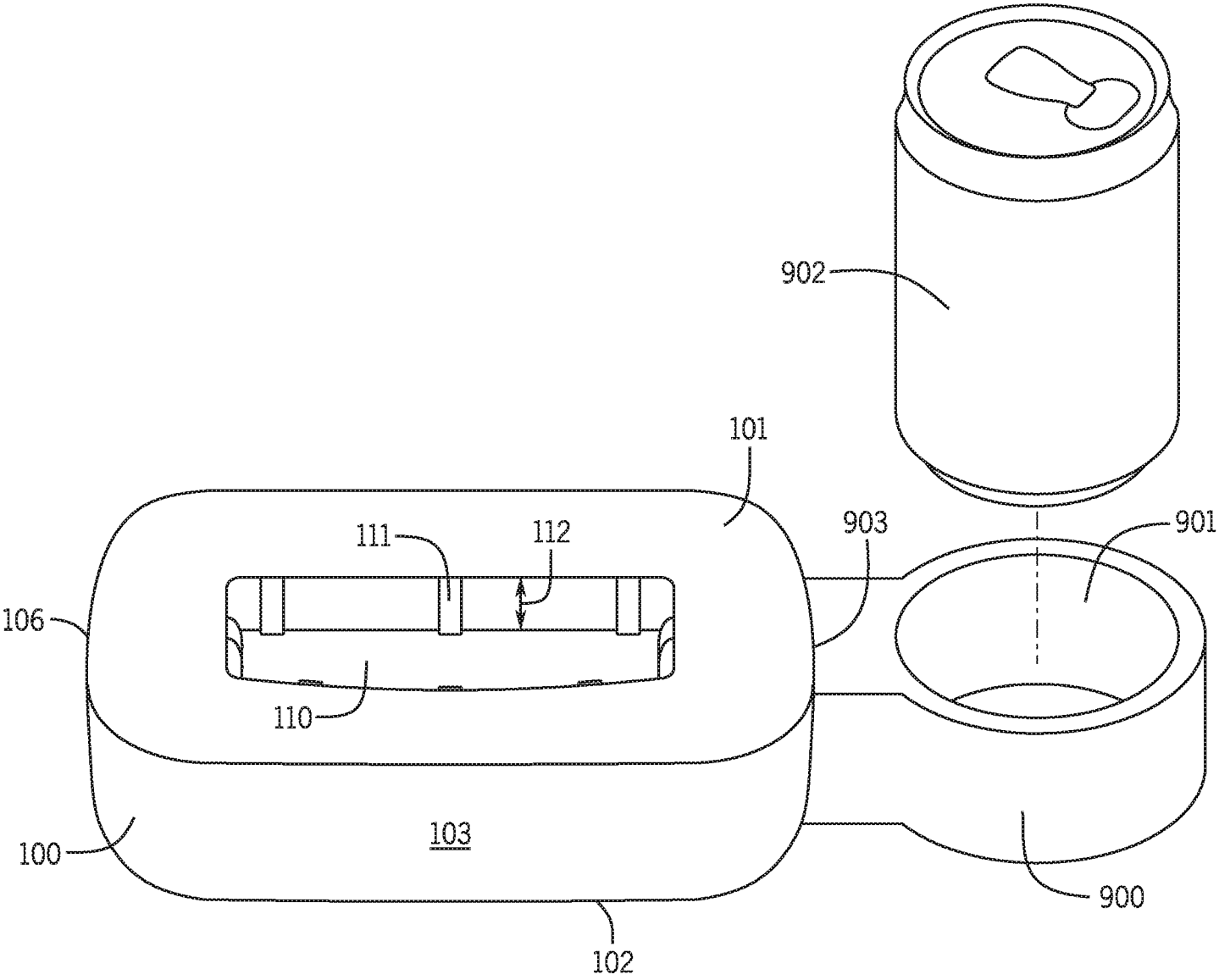
FIG. 7 illustrates an alternative embodiment wherein a cup holder is attached to at least one of the buoys of the game.

FIG. 7 illustrates an alternative embodiment of the game 1 wherein the buoys 100 may have a cup holder 900. The cup holder 900 may have an opening 901 which receives a beverage 902. The cup holder 900 may be removably attached to, for example, the side of the buoys 100 at a connection point 903. In an embodiment, the cup holder 900 is buoyant so as to provide further buoyance and stability to the game 1 in water 700.

Figure 8:
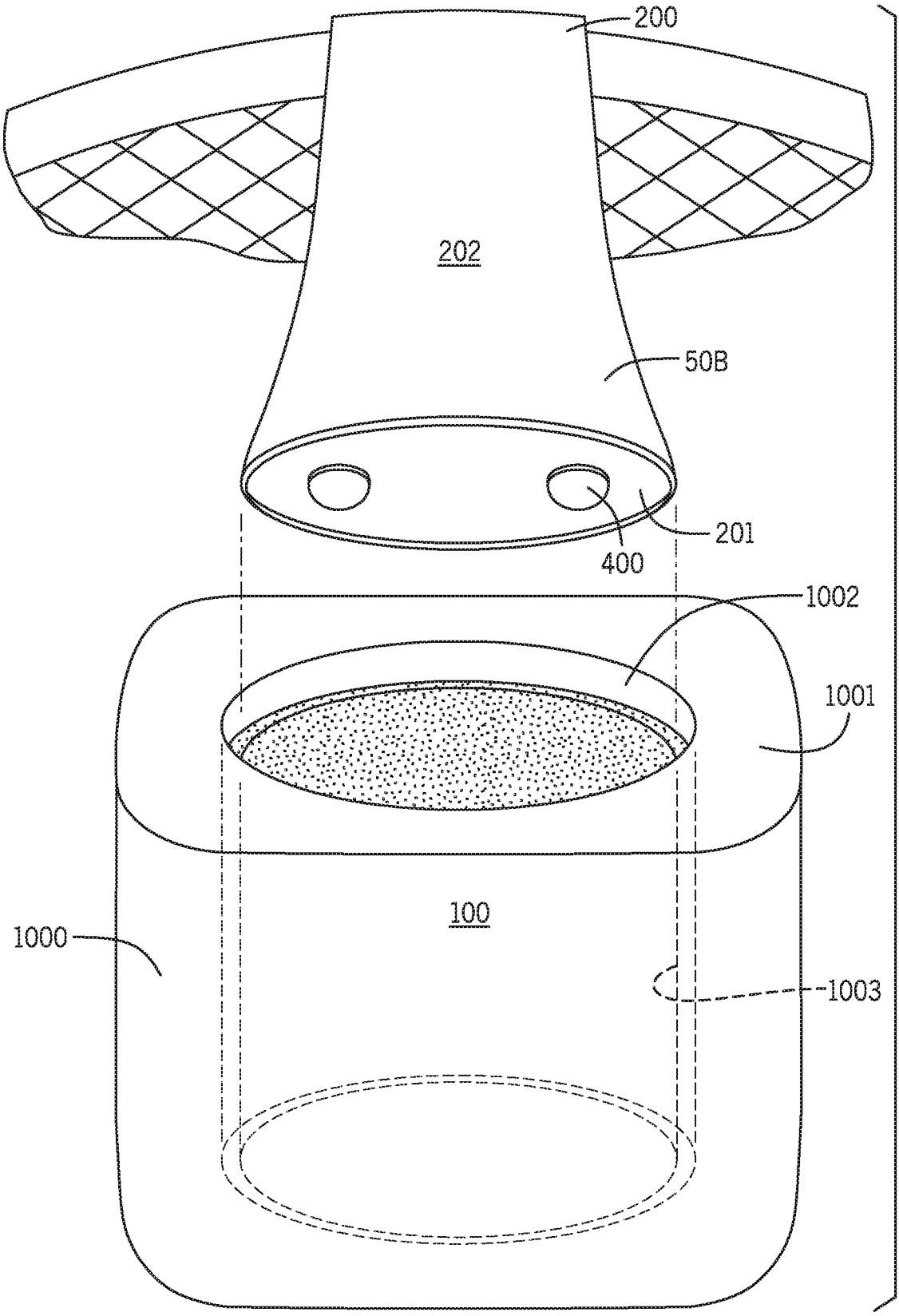
FIG. 8 illustrates alternative embodiment wherein the buoys are elongated and wherein the interior opening of the buoys have a semi-adhesive material surface, such as a rubber, which allows the legs to be adjusted at various heights in connection with the buoys.

Finally, referring now to FIG. 8, in an alternative embodiment, an elongated buoy 1000 is provided. The elongated buoy 1000 may have a top 1001 having an opening 1002. The opening 1002 may lead to a generally cylindrical hollow area which is coated by a semi-adhesive material 1003 along the interior side walls. In an embodiment, the semi-adhesive material is rubber. The material 1003 is 'sticky' and therein grips the end of the legs 50B and secures the legs 50 at some location within the generally cylindrical hollow area by friction. More specifically, a user may adjust the height of the legs 50 with respect to the buoys 1000 by moving the legs 50 up or down in the generally cylindrical hollow area so that the end of the legs 50 touches the material 1003 and is secured by the material 1003 at any point within the generally cylindrical hollow area (and not just at the bottom). Allowing a user to individually adjust the location of the legs 50 compared to the respective buoy 1000 also allows the game to be secured on an angle, if desired, so that the playing surface 30 is not parallel to the ground or water 700. More specifically, the playing surface 30 may be adjusted so that a taller player has the legs 50 on his/her side of the game 1 secured in higher orientation than a shorter player. In an embodiment, the semi-adhesive material 1003 may be utilized in the smaller buoys 100 of FIG. 1.

The individual buoys 100, 1000 or the buoyant ring 800 may be completely removed from the legs 50 and the game 1 played on land by resting the game 1 on the ground with the bottom 52 of the plurality of legs 50.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. An apparatus for playing a game comprising:

a frame member;

a flexible bouncing net surface attached to the frame member;

a plurality of legs having a top and a bottom wherein the top of each of the plurality of legs are attached to the frame member wherein the plurality of legs vertically elevates the frame member and the flexible bouncing net surface above land or water;

a plurality of buoys each having a hollow interior channel wherein the plurality of buoys are each individually removably secured to the bottom of the plurality of legs wherein the plurality of buoys is capable of supporting the entire game in water and wherein the plurality of legs support the frame member on land when the plurality of buoys are removed from the plurality of legs; and wherein the plurality of legs may be secured at various height levels within the hollow interior channels of the plurality of buoys therein allowing the legs and the frame member to be secured in a raised or a lowered orientation with respect to the plurality of buoys.

2. The apparatus for playing a game of claim 1 wherein the frame member is circular.

3. The apparatus for playing a game of claim 1 further comprising:

a plurality of straps wherein each of the plurality of buoys has a single strap and wherein the strap has a first end and a second end wherein the second end of a strap is secured to each of the buoys and wherein the first end of the strap is removably secured to a weighted anchor.

4. The apparatus for playing a game of claim 3 further comprising:

an adjustor clasp located on each of the plurality of straps wherein the adjustor clasp is capable of adjusting an overall length of each of the plurality of straps.

5. The apparatus for playing a game of claim 3 wherein the anchor is a foldable bag having an opening for temporarily receiving a non-buoyant material.

6. The apparatus for playing a game of claim 1 further comprising:

an extended protrusion on the bottom of the plurality of legs wherein the extended protrusions correspondingly fits with a surface located within an opening of the plurality of buoys and is capable of aligning the legs to the buoys.

7. The apparatus for playing a game of claim 6 wherein the protrusions are magnetic and are attracted to a second magnet located within the buoy.

8. The apparatus for playing a game of claim 1 further comprising:

an opening on each of the plurality of buoys wherein the openings on the plurality of buoys removably receives the bottom of the plurality of legs and temporarily secures the legs to the buoys.

9. The apparatus for playing a game of claim 8 further comprising:

a semi-adhesive material coating along an interior wall of the opening of the plurality of buoys wherein the semi-adhesive material coating is capable of securing the bottom of one of the plurality of legs at various positions within the opening of the plurality of buoys.

10. The apparatus for playing a game of claim 8 further comprising:

a second opening on the bottom of the plurality of buoys wherein the second opening is capable of temporarily securing an alternative leg having a different shape.

11. The apparatus for playing a game of claim 1 further comprising:

a cup holder having a top surface and a bottom surface wherein the cup holder is secured to at least one of the plurality of buoys; and an opening on the top surface of the cup holder wherein the cup holder is capable of temporarily holding and securing a beverage in a container.

12. The apparatus for playing a game of claim 8 further comprising:

at least one ridge within the opening of the plurality of buoys wherein the ridge is capable of creating pressure on the plurality of legs and capable of temporarily securing the plurality of legs by friction.

13. The apparatus for playing a game of claim 1 wherein the bouncing surface is a net.

14. The apparatus for playing a game of claim 1 wherein the frame and plurality of legs are buoyant.

15. An apparatus for playing a A game comprising:

a frame member;

a flexible bouncing net surface attached to the frame member;

a plurality of legs having a top and a bottom wherein each of the top of the plurality of legs are attached to the frame member wherein the plurality of legs elevates the frame member and the flexible bouncing net surface above land or water;

a single buoy removably secured to the bottom of the legs wherein the single buoys is capable of supporting the entire game in water and wherein the single buoy has a plurality of openings each having a hollow interior channel which secures the plurality of legs on water and wherein the plurality of legs support the frame member on land when the single buoy is removed from the bottom of the plurality of legs; and wherein the plurality of legs may be secured at various height levels within the hollow interior channels of the plurality of buoys therein allowing the legs and the frame member to be secured in a raised or a lowered orientation with respect to the single buoy.

16. The apparatus for playing a game of claim 15 wherein the single buoy is in the shape of a ring.

17. The apparatus for playing a game of claim 15 wherein the single buoy has a plurality of openings for temporarily receiving the plurality of legs.

* * * * *